US007284749B2

(12) United States Patent
Greene, III et al.

(10) Patent No.: US 7,284,749 B2
(45) Date of Patent: Oct. 23, 2007

(54) SHEET PROCESSING SYSTEMS AND METHODS

(75) Inventors: Jay E. Greene, III, Omaha, NE (US); Jeff G. Nowlin, Council Bluffs, IA (US); Fred C. Casto, Omaha, NE (US); Scott J. Smith, Omaha, NE (US); Timothy J. Walpus, Omaha, NE (US); Mark J. Wilson, Bellevue, NE (US)

(73) Assignee: First Data Corporation, Greenwood Village, CO (US)

( * ) Notice: Subject to any disclaimer, the term of this patent is extended or adjusted under 35 U.S.C. 154(b) by 261 days.

(21) Appl. No.: 10/946,910

(22) Filed: Sep. 21, 2004

(65) Prior Publication Data

US 2006/0061029 A1 Mar. 23, 2006

(51) Int. Cl.
*B65H 39/16* (2006.01)

(52) U.S. Cl. ..... 270/52.02; 270/1.02; 270/1.03; 270/52.03; 270/52.04

(58) Field of Classification Search ..... 270/1.02, 270/1.03, 52.02, 52.03, 52.04; 700/221, 700/222

See application file for complete search history.

(56) References Cited

U.S. PATENT DOCUMENTS

| | | | | | |
|---|---|---|---|---|---|
| 4,157,175 | A * | 6/1979 | Patterson | 270/52.11 |
| 4,429,217 | A * | 1/1984 | Hill et al. | 235/380 |
| 4,525,788 | A * | 6/1985 | Gottlieb et al. | 700/221 |
| 4,527,468 | A * | 7/1985 | Piotroski | 101/2 |
| 4,527,790 | A * | 7/1985 | Piotroski | 270/52.09 |
| 4,574,692 | A * | 3/1986 | Wahli | 101/2 |
| 5,067,088 | A * | 11/1991 | Schneiderhan | 700/221 |
| 5,191,540 | A * | 3/1993 | Ramsey | 700/221 |
| 5,317,654 | A * | 5/1994 | Perry et al. | 382/101 |
| 5,608,639 | A * | 3/1997 | Twardowski et al. | 700/125 |
| 5,734,566 | A * | 3/1998 | Stengl | 700/9 |
| 5,754,434 | A * | 5/1998 | Delfer et al. | 700/223 |
| 5,838,574 | A * | 11/1998 | Olson et al. | 700/219 |
| 5,923,015 | A * | 7/1999 | Hill et al. | 235/380 |
| 6,370,445 | B1 * | 4/2002 | Olson et al. | 700/219 |
| 6,623,415 | B2 | 9/2003 | Gates | |
| 6,629,006 | B1 * | 9/2003 | Weinmann | 700/100 |
| 6,802,500 | B2 | 10/2004 | Bennett et al. | |
| 6,974,034 | B2 * | 12/2005 | Smith et al. | 209/3.3 |
| 2003/0112479 | A1 * | 6/2003 | Huber et al. | 358/498 |

* cited by examiner

*Primary Examiner*—Gene O Crawford
*Assistant Examiner*—Leslie A. Nicholson, III
(74) *Attorney, Agent, or Firm*—Townsend and Townsend and Crew LLP

(57) ABSTRACT

Systems and methods for processing sheets, statements, and/or inserts prior to mailing are provided. One sheet processing system includes a receiver adapted to receive first and second sheets to be processed. The first sheet originates from a stack of first sheets or a continuous form sheet, and the second sheet originates from a stack of second sheets or a continuous form sheet. The system includes a first read head adapted to read a first identifier from the first sheet, and a second read head adapted to read a second identifier from the second sheet. A circuit coupled to the first and second read heads is adapted to compare the first and second identifiers to determine whether a match exists. In this manner, the sheet processing system is able to confirm that the first and second sheets are both intended to be sent to the same customer.

26 Claims, 8 Drawing Sheets

SHEET PROCESSING SYSTEMS AND METHODS

BACKGROUND OF THE INVENTION

The invention relates generally to mail processing equipment, and more specifically, to systems and methods for processing sheets, statements and/or inserts prior to mailing.

Financial institutions including credit card companies mail literally millions of documents within the United States each week. For example, credit card customers can expect to receive a monthly statement summarizing their charges for the prior month, or longer. With these monthly statements, the customers may receive other information or printed inserts, including advertisements, offers for additional services, account information, checks for use by the customer, replacement cards, and the like. The inserts may or may not be specifically directed to a particular customer, or class of customers. The credit card companies, or other parties that prepare the mailings for them, are constantly on the lookout for improvements in efficiency, speed, and cost savings. Even incremental improvements in processing speed or efficiency can produce large benefits due to the huge number of mailings. Thus, improvements to mail processing systems or methods are desired.

BRIEF SUMMARY OF THE INVENTION

The invention relates generally to mail processing equipment, and more specifically, systems and methods for processing sheets, statements, and/or inserts prior to mailing. In some embodiments, the systems and methods of the present invention will be particularly useful for processing customer statements and sheets of checks or other inserts that may be sent to the customer. The checks may be used for transferring a balance from one credit card to a credit card for the company issuing the customer statement. Other uses for the checks also may fall within the scope of the present invention.

A sheet processing system according to one embodiment of the present invention includes a receiver adapted to receive a first sheet and a second sheet to be processed. The first sheet originates from a stack of first sheets, and the second sheet originates from a stack of second sheets. In some embodiments, the stacks of sheets are continuous form sheets. The system includes a first read head adapted to read a first identifier from the first sheet, and a second read head adapted to read a second identifier from the second sheet. The system includes a circuit coupled to the first and second read heads and adapted to compare the first and second identifiers to determine whether a match exists. In this manner, the sheet processing system is able to confirm that the first and second sheets are both intended to be sent to the same customer.

In one aspect, the receiver includes at least one rotatable pin wheel having a plurality of pins adapted to be received in holes in the first sheet. The plurality of pins may further be adapted to be received in holes in the second sheet. In a particular aspect, the first and second sheets pass together over the pin wheel if the match exists. In one aspect, passing together over the pin wheel comprises a synchronized passing so that a beginning and an end of the first and second sheets coincide with each other. In one aspect, the first sheet includes at least one customer statement and the second sheet includes a check sheet. In another aspect, the first sheet includes first and second customer statements.

In some aspects, the system includes third and fourth read heads. The third read head is adapted to read a third identifier from the first sheet associated with a second customer statement. The fourth read head is adapted to read a fourth identifier from the second sheet. In this manner, the first sheet may include two different customer statements while the second sheet includes checks or other paperwork intended for the same two customers. In some aspects the circuit is adapted to compare the third and fourth identifiers to determine whether a match exists for the second customer.

In some aspects, the system includes a first separator adapted to separate the first and second customer statements from one another. The separator may further be adapted to separate the first customer checks from the second customer checks on the second sheet. In some aspects, the system includes a second separator adapted to separate a received portion of the first sheet from a next portion of the first sheet. In this manner, the sheet containing one or more customer statements may be separated from a next sheet containing the next group of customer statements. In some aspects, first and second sheets are continuous form sheets that are received by the receiver from two different directions and transferred from the receiver to a second separator in a same direction. In this manner, the sheets are maintained separate until it is desired that they be coupled or positioned together. As a result, paper jams can be reduced or avoided, the ability to read the identifiers is improved, and the like. In some aspects, first and second identifiers include first and second uniform product codes. The identifiers may both have a same sequence number when the match exists. Systems of the present invention may have additional components. In one aspect, a printer is coupled to the receiver and adapted for printing customer statements on the first sheet. An edge remover, adapted to remove edges from the first and/or second sheets, is included in some embodiments.

In another embodiment of the present invention, a system for processing sheets includes a host computer having a circuit coupled to a sheet processing unit. The sheet processing unit may be similar to those described above or herein below. The circuit is adapted to receive input from first and second readers, with the input related to at least a portion of the first and second identifiers. The circuit further compares the received inputs to determine if the portion of the first and second identifiers match. In some aspects, the host computer is coupled to an indicator, with the indicator adapted to indicate if a mismatch is determined between the portion of the first and second identifiers.

The present invention also provides methods for processing sheets prior to mailing. One such method includes receiving first and second sheets with a receiver, reading a first identifier on the first sheet with a first read head, and reading a second identifier on the second sheet with a second read head. The method includes comparing the two identifiers to determine whether a match exists and signaling an error if the two identifiers do not match.

In some aspects, the first sheet includes a first customer account statement having a first identifier and the second sheet includes a check associated with the first customer account having the second identifier. The method may further include retrieving at least one insert to match with the first customer statement based at least in part on the first identifier. In this manner, the first identifier may be used to help determine whether a match exists between the first and second sheets, and also may contain data to identify further inserts that are to be sent to the customer. In some aspects, the first sheet includes customer statements for first and second customers, and the second sheet includes checks associated with the first and second customers' accounts. In one aspect, the method includes separating the check associated with the first customer account from the check associated with the second customer account at a same time as separating the first and second customer account statements.

Other objects, features, and advantages of the present invention will become more fully apparent from the following description, the appended claims, and the accompanying drawings.

DETAILED DESCRIPTION OF THE INVENTION

Figure 1:
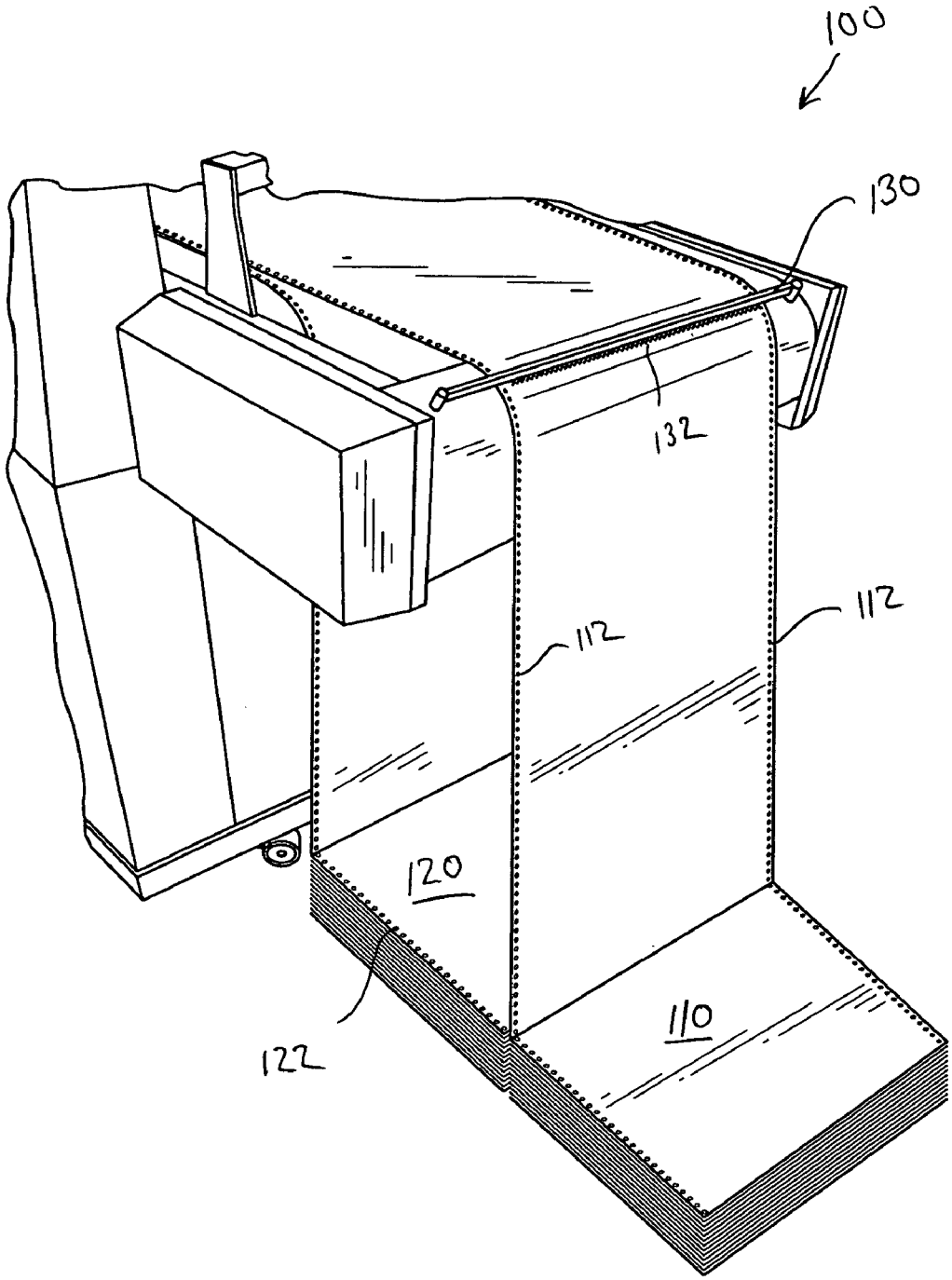
FIG. 1 is an overall view of a sheet processing system according to an embodiment of the present invention.
Figure 2:
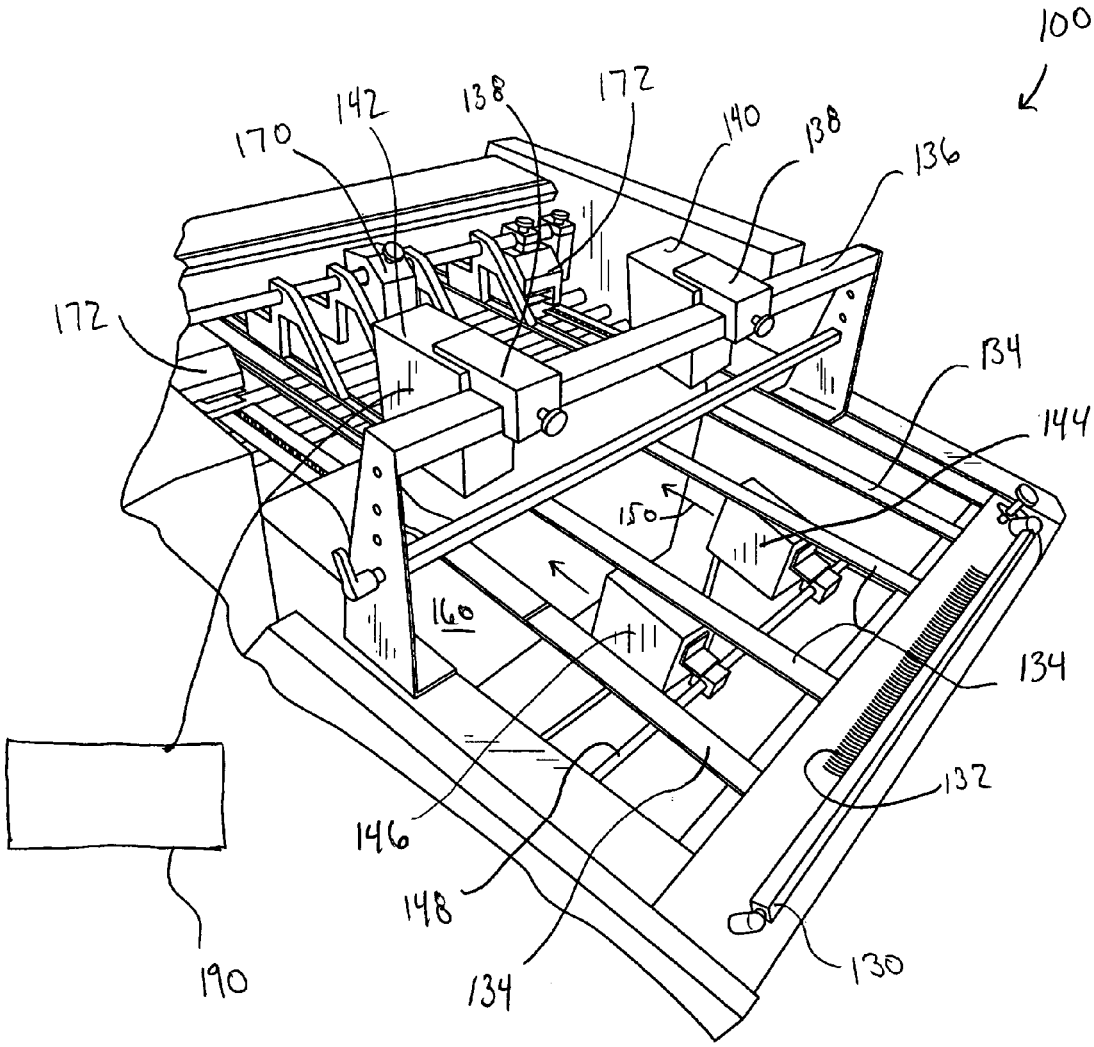
FIG. 2 is an overall view of a portion of the sheet processing system shown in FIG. 1.
Figure 3:
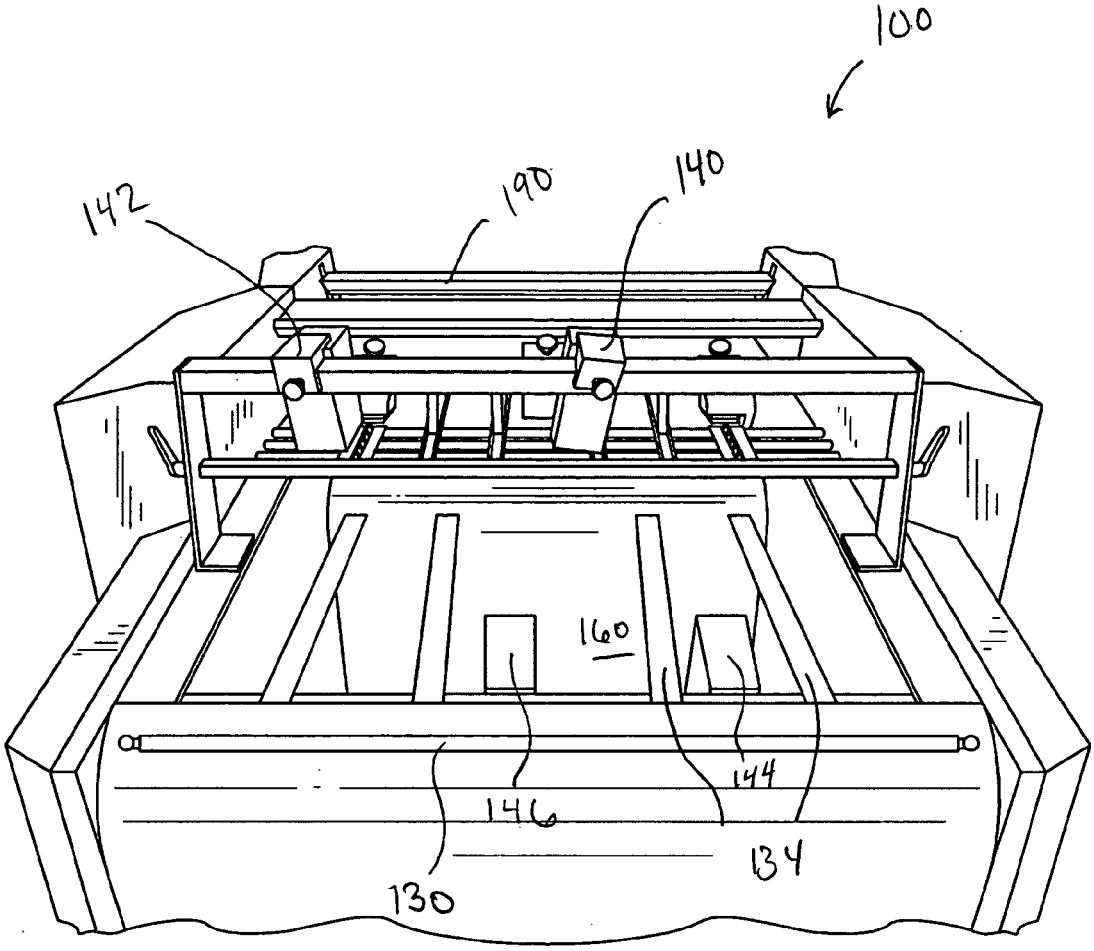
FIG. 3 is a front view of the sheet processing system portion shown in FIG. 2.

FIGS. 1-3 depict a sheet processing system 100 according to an embodiment of the present invention. System 100 processes a stack of first sheets 110 and a stack of second sheets 120. In some embodiments, first sheet 110 is a continuous form sheet as depicted in FIG. 1. Continuous form sheet 110 has a plurality of spaced perforations separating individual sheet pages of the continuous form sheet 110 from subsequent sheets. Similarly, second sheets 120 may comprise a continuous form sheet according to an embodiment of the present invention. In one embodiment, sheet 110 has a plurality of holes 112 disposed along one or both outer edges of sheet 110. Similarly, sheet 120 has a plurality of holes 122 disposed along one or both outer edges of sheet 120. In some embodiments, holes 112 and 122 are formed in an edge portion of sheets 110 and 120. The edge portions may be separated from the remainder of the sheet by a perforation. This perforation facilitates removal of the edge strips containing holes 112, 122, after or during processing through system 100. Holes 112 and 122 are adapted to engage a receiver within system 100 as further shown in FIGS. 4A-4B. Sheets 110 and 120 may comprise a variety of sizes. In one embodiment, the continuous form sheets 110 and 120 are separable along perforations into separate sheets or pages. The sheets or pages may be any size of paper, including letter, legal, and the like.

Figure 4A:
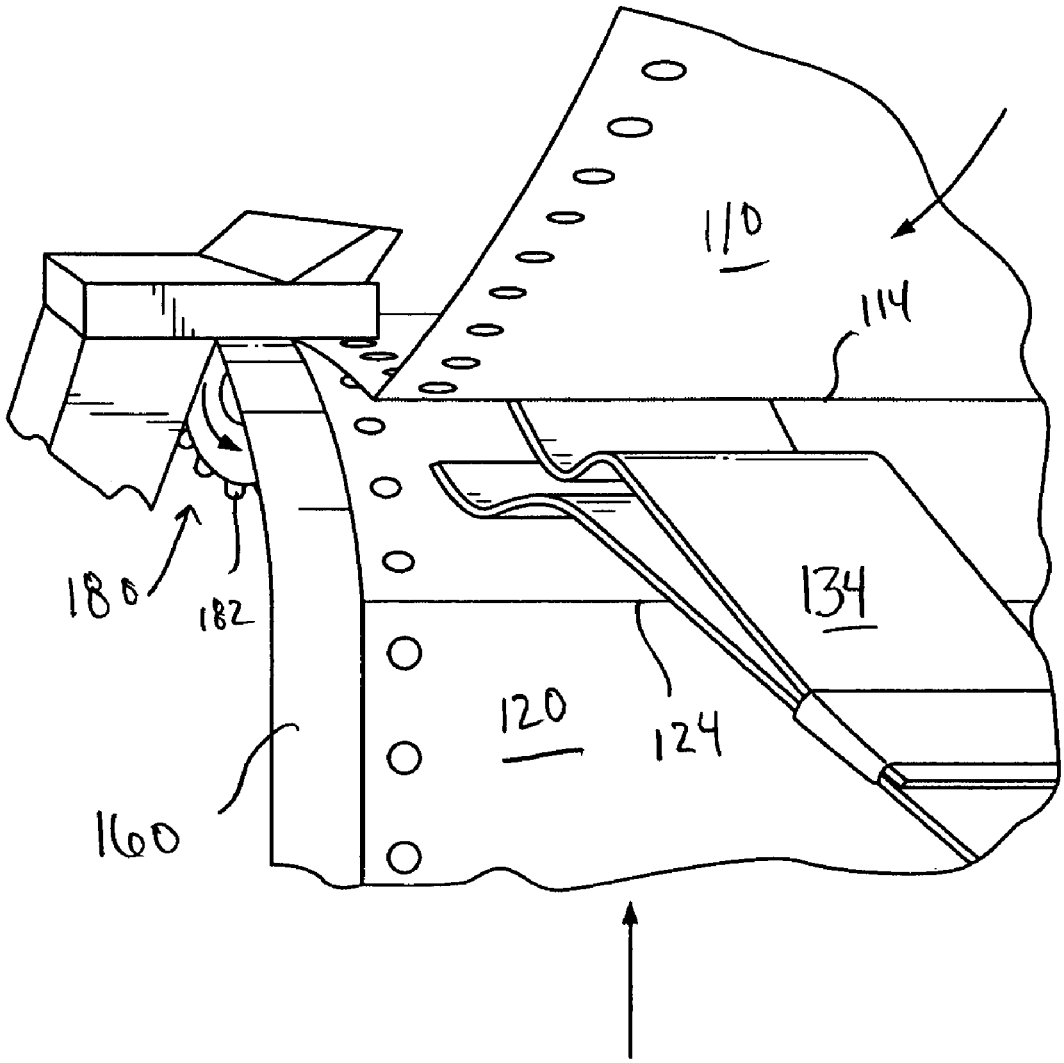
FIGS. 4A and 4B are overall views of first and second sheets engaging a receiver of the present invention.
Figure 4B:
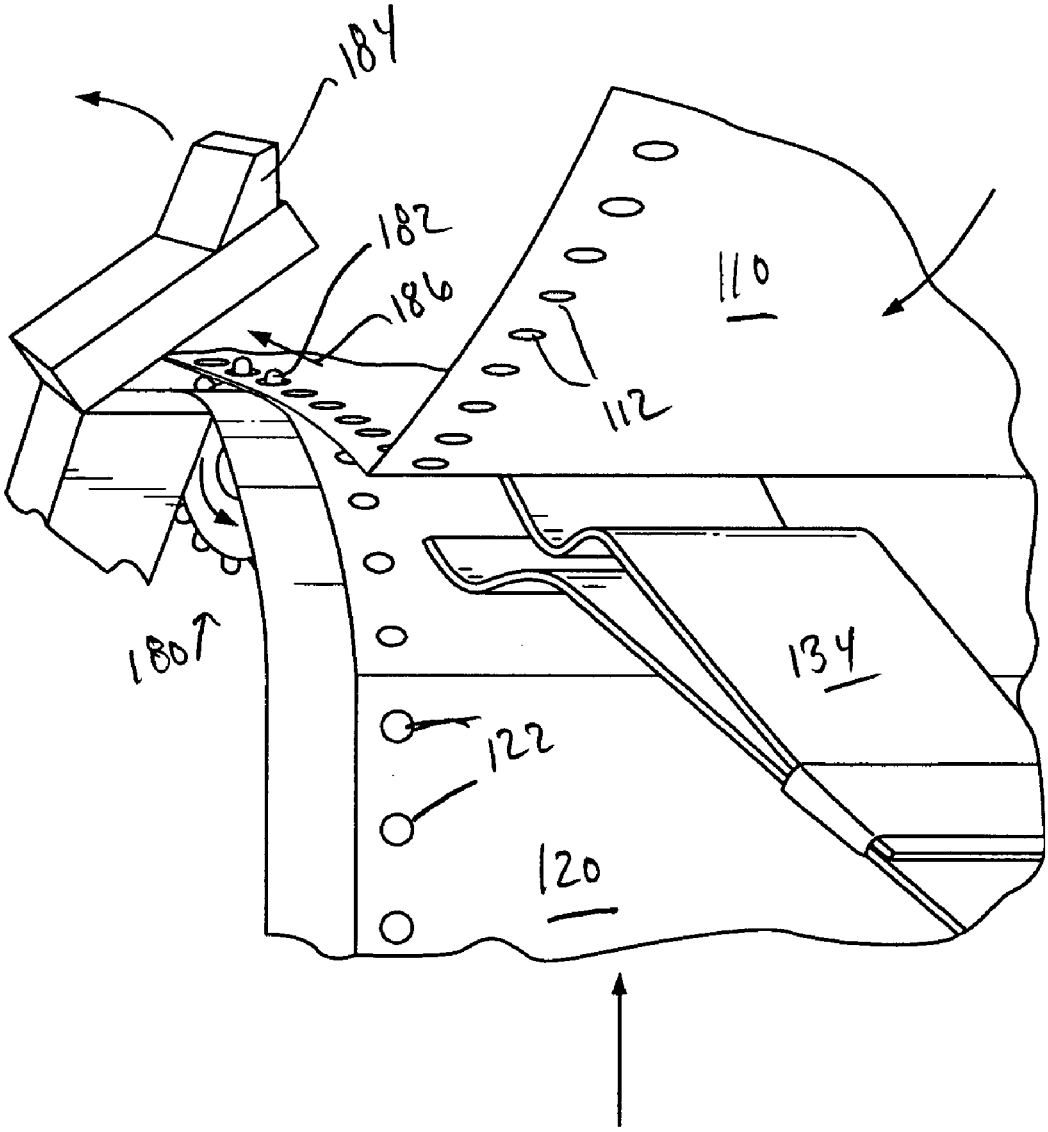

System 100 includes two or more paths along which sheets 110 and 120 are received by system 100. In one embodiment, continuous form sheet 110 passes over a front edge of system 100, and passes under a horizontal bar 130. In one embodiment, bar 130 has a brush 132 that extends from bar 130 to help control sheet 110 passing thereunder. In a particular embodiment, continuous form sheet 110 passes under brush 132 and proceeds along a plurality of guide rails 134. FIG. 2 depicts four guide rails 134 approximately evenly spaced to guide sheet 110 towards a receiver disposed within system 100. In one embodiment, the receiver within system 100 is a pinwheel 180, as best seen in FIGS. 4A and 4B. In a particular embodiment, pinwheel 180 is a rotatable wheel having a plurality of pins 182 that engage holes 112 in first sheets 110 and holes 122 disposed in second sheets 120. In one embodiment, system 100 is loaded with first sheet 110 and/or second sheet 120 by placing holes 112, 122 over pins 182. In this manner, the rotation of pinwheel 180 draws first sheet 110 under brush 132 and along guide rails 134. The rotation of pinwheel 180 also draws second sheet 120 into system 100.

In one embodiment, as first sheet 110 passes along guide rails 134, one or more identifiers are read from sheet 110. The identifiers may include a customer name, a customer account, a bar code such as a Uniform Product Code (UPC), a magnetic stripe, or the like. In a particular embodiment, a first read head 140 and a second read head 142 are positioned adjacent the path along which sheet 110 passes. Read heads 140 and 142 may comprise optical read heads, scanners for reading Uniform Product Codes (UPC), and the like. As shown in FIG. 2, read heads 140 and 142 are each coupled to a bar 136 using a clamp 138. Clamp 138 is adjustable to position read heads 140 and 142 at a desired location along bar 136. In the embodiment shown in FIG. 2, read heads 140 and 142 read identifiers from sheet 110 as sheet 110 passes under bar 136. In the particular embodiment of FIG. 2, read heads 140 and 142 each have a downward looking sensor, or the like.

In the embodiment shown in FIGS. 1-3, second sheet 120 enters system 100 at a different location than does sheet 110. In one embodiment sheets 120 extend up a wall 160 that is positioned below guide rails 134. Wall 160 is used to control the flow of sheet 120 from the stack of second sheets 120 shown in FIG. 1. In another embodiment (not shown), both first and second sheets 110, 120 are fed over the front edge of system 100 and pass under bar 130. In still another embodiment, both first and second sheets 110, 120 enter system 100 from underneath, passing up wall 160.

As can best be seen in FIG. 2, system 100 includes third and fourth read heads 144 and 146. Read heads 144 and 146 are coupled to a bar 148, and may be positioned at a desired location along bar 148. In a particular embodiment, read heads 144 and 146 are slidably coupled to bar 148. Read heads 144 and 146 are adapted to read towards wall 160 as shown by arrow 150 in FIG. 2. In this manner, sheets 120 passing up wall 160 may be read by forward facing read heads 144 and 146.

In a particular embodiment, first continuous sheet 110 has a plurality of customer statements. The customer statements may include bank statements, credit card statements, store credit statements, customer award account statements, or the like. Second sheets 120 comprise advertisements, inserts, or the like that are desired to be sent to customers having statements being processed by system 100. In a particular embodiment, sheets 120 include one or more checks for use by customers whose statements are contained in first sheets 110. For example, a credit card company may want to send checks for their credit card customers to use, so that the customers can transfer balances from other credit cards to the credit cards associated with the statements on sheet 110.

In a particular embodiment, it is desirable to ensure that customer statements contained on sheets 110 are correctly matched with checks or other printed materials contained on or consisting of sheets 120. In one embodiment, system 100 accomplishes this by using read heads 140, 142, 144 and 146 to read identifiers contained on sheets 110 and 120. More specifically, read heads 140-146 are adapted to read identifiers contained on statements, checks, printed material, or the like that are printed on sheets 110 and 120. In one embodiment, a single page which can be separated from continuous sheet 110 has two customer statements thereon. The two customer statements may be positioned in a side-by-side arrangement, top and bottom arrangement, or the like. In this embodiment, sheet 110 is fed into system 100 and read heads 140 and 142 are adapted to read identifiers from sheet 110. In one embodiment, read head 140 reads a first customer statement identifier and read head 142 reads a second customer statement identifier. Similarly, sheet 120 is fed into system 100 in a manner that causes sheet 120 to pass by read head 144, 146. Read head 144 operates to read an identifier from sheet 120 and read head 146 operates to read an identifier from sheet 120. In a particular embodiment, read heads 144 and 146 read customer account identifiers from check portions or the like of sheet 120.

In this embodiment, read head 140 and read head 144 are looking for matching identifiers corresponding with the same customer. For example, read head 140 may be reading a customer statement identifier, while read head 144 is reading an identifier on a sheet of checks intended for the same customer. Similarly, read heads 142 and 146 are reading customer identifiers from sheets 110 and 120, respectively. Matching customer identifiers would indicate that the statement on sheet 110 and checks on sheet 120 are intended for the same customer.

In one embodiment, a system controller 190 is coupled to read heads 140-146. Controller 190 includes a circuit, having appropriate software, memory, and a microprocessor. The circuit of controller 190 receives input from read heads 140-146. The input may comprise a portion of the customer identifiers read from sheets 110 and 120, or may contain the entire identifiers read from sheets 110 and 120. The circuit operates to verify that read heads 140 and 144 have read the same identifier, or portion thereof identifying the customer. The circuit further operates to verify that read heads 142 and 146 have read the same identifier, or portion thereof identifying the customer. In this manner, system 100 verifies that the checks or the printed material on second sheet 120 and customer statement on sheet 110 are passing through system 100 in a synchronized manner. As a result, sheets 110 and 120 are matched so that each customer's materials are matched or joined together for mailing to the customer.

In an alternative embodiment, a greater number of read heads are used with system 100. In a particular embodiment, bar 136 has mounted thereto a number of read heads which correspond to the number of identifiers desired to be read from first sheet 110 at a same time. For example, if smaller customer statements or materials are printed so that more than two statements exist on a single page, then a like number of read heads are used. Similarly, a greater number of read heads may be mounted to bar 148 so read identifiers from second sheet 120. In a particular embodiment, the number of read heads mounted to bar 148 is the same as the number of read heads mounted to bar 136.

With reference to FIGS. 2 and 3, additional features of system 100 will be further described. More specifically, in one embodiment as previously noted, sheets 110 and 120 contain printed materials (statements, checks, or the like) for one, two or more customers. In this embodiment, it will be desirable to separate the first customer statement, for example, from the second customer statement. System 100 includes a cutting device 170 which may include a knife, a razor, or the like. Cutter 170 may include a movable knife portion that extends and retracts as sheets 110 pass by cutter 170. In another embodiment, cutter 170 operates to cut not only sheet 110 but also underlying sheet 120 as sheets 110, 120 pass cutter 170.

In a similar fashion, perforated edges of sheets 110 and 120 may be removed prior to additional processing or mailing of the customer statements. This is accomplished, in one embodiment, by using one or more edge cutters 172, as best shown in FIG. 2. Edge cutters 172 may comprise a knife, razor, or the like, that operates to trim the edges containing holes 112 and 122 from sheets 110 and 120, respectively. The edges of sheets 110 and 120 may be perforated, to facilitate the edge trimming.

In a particular embodiment, system 100 further includes a separator adapted to separate adjoining pages in sheet stacks 110 and 120. As previously mentioned, continuous form sheet 110 may comprise a plurality of perforated pages. The plurality of pages may be folded back upon each other in an accordion-like fashion to create a stack, or may be fed into system 100 without first forming a stack. With reference to FIG. 4A, in one embodiment continuous form sheet 110 includes a number of generally horizontal perforations 114 extending along a width of sheet 110. Perforations 114 separate continuous form sheet 110 into individual pages of desired dimensions. In one embodiment, the page size used with sheet 110 is the same as the page size used with sheet 120. In this manner, when perforations 114 and 124 are aligned, the next perforations 114 and 124 in sheets 110 and 120 also are aligned.

In one embodiment, system 100 includes a horizontal separator 190 adapted to cut along perforation 114 to separate a received portion of continuous form sheet 110 from a next portion of continuous form sheet 110. Cutter 190 may comprise a bar cutter that extends downward into sheet 110 as perforation 114 is positioned under cutter 190. Cutter 190 then retracts to an upper position, waiting for the next perforation 114 separating the next two pages in continuous form sheet 110. In one embodiment, cutter 190 cuts completely through not only perforation 114 but also a perforation 124 in second sheet 120. In a particular embodiment, the reading of identifiers on sheets 110 and 120 are used to ensure perforations 114 and 124 are aligned. In this manner, cutter 190 separates the received portion of both first sheet 110 and second sheet 120 from a next portion of first sheet 110 and second sheet 120, respectively.

In a particular embodiment, horizontal cutter 190 is positioned downstream from receiver 180, so that the separation using cutter 190 is made while receiver 180 has the next sheets firmly in its grasp. As can be seen in FIGS. 4A and 4B, guide members 134, in one embodiment, terminate prior to receiver 180. In this manner, second sheet 120 may enter from the under side of system 100 to join with first sheet 110 prior to or upon entering receiver 180, shown as pinwheel 180 in FIG. 4A. In a particular embodiment, first sheet 110 and second sheet 120 enter receiver 180 from generally perpendicular directions. Sheets 110 and 120 pass together over receiver 180 and exit sheet receiver 180 in a same direction, as shown by arrow 186 in FIG. 4B. In this manner, receiver 180 helps properly direct sheets 110 and 120 so that statements, checks, or the like remain synchronized prior to separation. As shown in FIG. 4B, receiver 180 may include a lid 184 that clips down over a pinwheel or other rotation device. In this manner, lid 184 helps prevent pins 182 from slipping out of holes 112 and 122.

Figure 5:
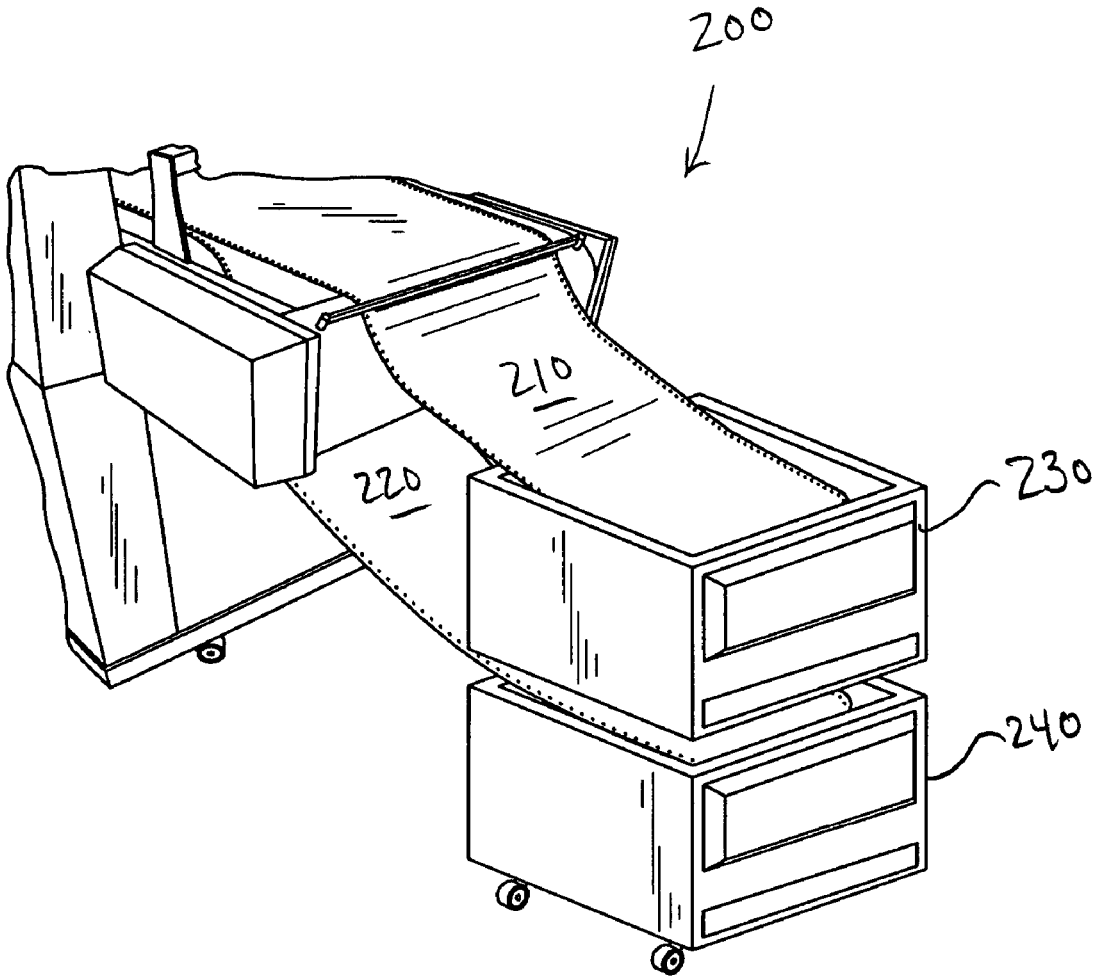
FIGS. 5-6 are overall views of sheet processing systems according to alternative embodiments of the present invention.

An alternative embodiment of a sheet processing system 200 according to the present invention is depicted in FIG. 5. Sheet processing system 200 is adapted to process first continuous form sheet 210 and second continuous form sheet 220. Again, sheets 210 and 220 may comprise customer statements, checks, or a wide variety of printed materials. In this embodiment, sheet 210 is fed into system 200 from a printer 230. In one embodiment, printer 230 is adapted to print customer statements. In another embodiment, printer 230 is adapted to print a customer identifier on customer statements, checks, or the like contained on sheet 210. Similarly, continuous form sheet 220 enters system 200 from a printer 240. Printer 240 again may be adapted to print customer identification numbers, UPC, customer statements, or a wide variety of alphanumeric characters on sheet 220 prior to entering system 200. Printers 230 and 240 may comprise dot matrix printers, laser printers, or other types of printers capable of printing onto paper, cardboard, film, or other material used for sheets 210 and 220.

Figure 6:
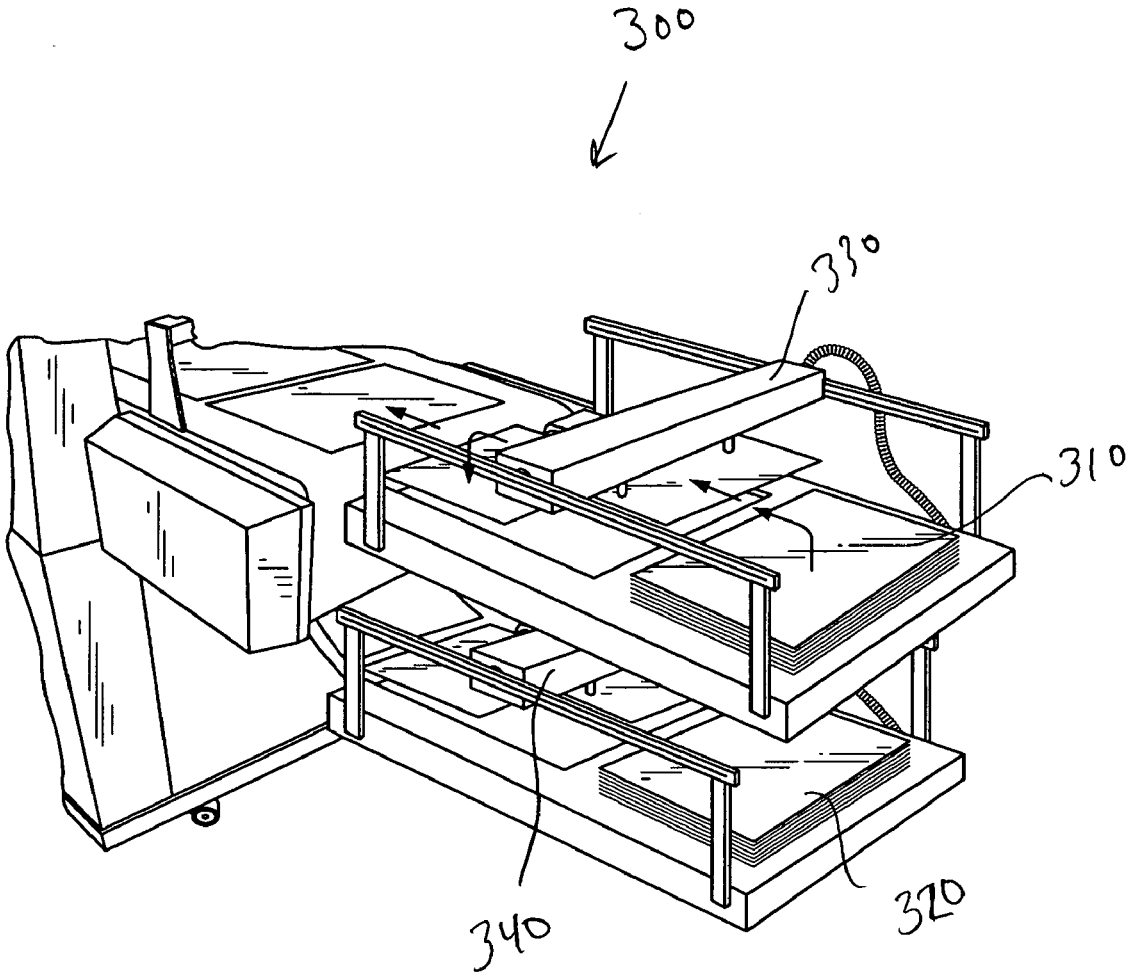
Figure 7:
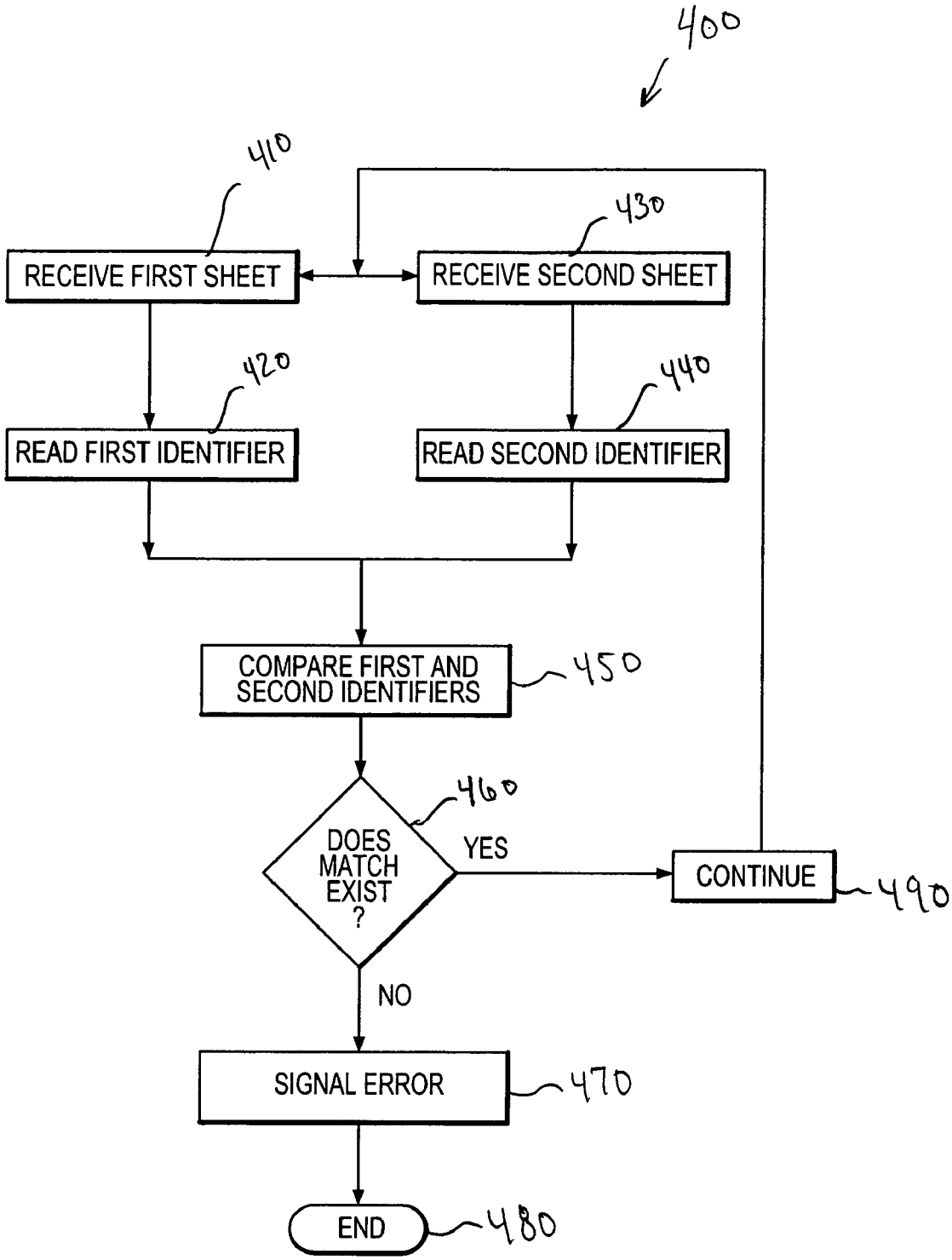
FIG. 7 is a method of processing sheets according to an embodiment of the present invention.

FIG. 6 depicts still another embodiment of a sheet processing system 300 according to the present invention. In this embodiment, the sheets are single page sheets as opposed to the continuous form sheets depicted in earlier embodiments. More specifically, a stack of first sheets 310 and a stack of second sheets 320 are fed into system 300. In one embodiment, a suction device 330 operates to grasp a top sheet from the stack of first sheets 310 and transfer the top sheet towards or into system 300. Similarly, a vacuum device 340 operates to lift a top sheet from the stack of second sheets 320 and pass the sheet towards or into system 300. In one embodiment, individual sheets 310 and 320 are placed onto conveyor belts by vacuum devices 330 and 340. The conveyor belts proceed into system 100 where customer identifiers are read from sheets 310 and 320 using read heads in a similar manner as described in conjunction with earlier embodiments. The customer statements are matched with appropriate inserts, checks, or the like within system 300.

Turning now to FIG. 4, a method of processing sheets 400 according to an embodiment of the present invention will be described. Method 400 includes receiving a first sheet (Block 410) and reading a first identifier from the first sheet (Block 420). As previously discussed, this may include passing a first sheet into the sheet processing system and reading the first identifier using a read head. Method 400 includes receiving a second sheet (Block 430) and reading a second identifier from the second sheet (Block 440). The method includes comparing the first and second identifiers (Block 450) to determine whether a match exists (Block 460). If a match does not exist, an error is signaled (Block 470) and the processing through the sheet processing system may be temporarily halted (Block 480). If a match between the first and second identifiers does exist, then it is presumed that the papers are appropriately matched for subsequent mailing to a same customer. In this manner, the processing will continue (Block 490) by receiving a second set of first and second sheets.

Once the systems of the present invention verify that the customer identifiers match, and the received customer statements and checks or other printed material are separated from subsequent statements and checks, the matched statement and checks or the like may proceed into other processing systems to facilitate mailing to a customer. In one embodiment, the processed sheets are transferred to sheet folding, processing, and/or envelope inserting systems, such as those described in U.S. Pat. No. 6,623,415, entitled Sheet Folding Systems and Methods, or in U.S. application Ser. No. 10/045,589, entitled Systems and Methods of Providing Inserts into Envelopes, both assigned to the assignee of the present invention, the complete disclosures of each being incorporated herein by reference. Further, matched sheets 110/120, 210/220, and/or 310/320 may be processed by other inserter or mailing apparatus within the scope of the present invention.

The invention has now been described in detail. However, it will be appreciated that the invention may be carried out in ways other than those illustrated in the aforesaid discussion, and that certain changes and modifications may be practiced within the scope of the appended claims. Accordingly, the scope of this invention is not intended to be limited by those specific example, but rather to be accorded the scope represented in the following claims.

What is claimed is:

1. A sheet processing system, comprising:
- a receiver adapted to receive a first sheet and a second sheet to be processed, wherein at least one of the first and second sheets comprises multiple documents, the first sheet originating from a stack of first sheets and the second sheet originating from a stack of second sheets;
- a first read head adapted to read a first identifier from the first sheet;
- a second read head adapted to read a second identifier from the second sheet;
- a third read head adapted to read a third identifier from the first sheet;
- a fourth read head adapted to read a fourth identifier from the second sheet;
- a circuit coupled to the first, second, third and fourth read heads, the circuit adapted to compare the first and second identifiers to determine whether a match exists and to compare the third and fourth identifiers to determine whether a match exists.

2. The system as in claim 1 wherein the receiver comprises at least one rotatable pin wheel, the pin wheel having a plurality of pins adapted to be received in a first plurality of holes in the first sheet.

3. The system as in claim 2 wherein the plurality of pins are adapted to be received in a second plurality of holes in the second sheet.

4. The system as in claim 3 wherein the first and second sheets pass together over the pin wheel if the match exists.

5. The system as in claim 1 wherein the multiple documents on the first sheet comprise at least one customer statement and the multiple documents on the second sheet comprise at least one check sheet.

6. The system as in claim 5 wherein the multiple documents on the first sheet comprise first and second customer statements.

7. The system as in claim 6 wherein:
- the first read head is adapted to read the first identifier from the first sheet associated with the first customer statement;
- the second read head is adapted to read the second identifier from the second sheet associated with first customer checks;
- the third read head is adapted to read a third identifier from the first sheet associated with the second customer statement; and
- the fourth read head is adapted to read a fourth identifier from the second sheet associated with second customer checks.

8. The system as in claim 6 further comprising a first separator adapted to separate the first and second customer statements from one another.

9. The system as in claim 8 wherein the second sheet comprises first and second customer checks, the separator adapted to separate the first customer checks from the second customer checks.

10. The system as in claim 8 wherein the stack of first sheets is a first continuous form sheet, the system further comprising a second separator adapted to separate a received portion of the first continuous form sheet from a next portion of the continuous form sheet.

11. The system as in claim 10 wherein the first and second continuous form sheets are received by the receiver from two different directions, and are transferred from the receiver to the second separator in a same direction.

12. The system of claim 11, wherein the two different directions are generally perpendicular to each other.

13. The system as in claim 1 wherein the first and second identifiers comprise first and second uniform product codes, the first and second identifiers both having a same sequence number when the match exists.

14. The system as in claim 1 further comprising a printer coupled to the first sheet and adapted for printing first and second customer statements thereon.

15. The system as in claim 1 further comprising an edge remover adapted to remove a first sheet edge and a second sheet edge.

16. The system of claim 1, wherein the first identifier is on a first document of the first sheet, the second identifier is on a first document of the second sheet, the third identifier is on a second document of the first sheet, and the fourth identifier is on a second document of the second sheet.

17. The system of claim 16, wherein the first and second documents of the first sheet are customer statements for different customers, and the first and second documents of the second sheet are checks for different customers.

18. A system for processing sheets prior to mailing, comprising:

a host computer having a circuit coupled to a sheet processing unit, the sheet processing unit comprising:

a receiver adapted to receive first and second continuous form sheets;

first, second, third and fourth readers, the first reader adapted to read a first identifier from the first continuous form sheet, the second reader adapted to read a second identifier from the second continuous form sheet, the third reader adapted to read a third identifier from the first continuous form sheet, and a fourth reader adapted to read a fourth identifier from the second continuous form sheet;

a first separator adapted to separate a received portion of the first and second continuous form sheets from a next portion of the first and second continuous form sheets; and wherein the circuit is adapted to receive input from the first, second, third and fourth readers related to at least a portion of the first, second, third and fourth identifiers, and to compare the received input to determine if the portion of the first and second identifiers match and the portion of the third and fourth identifiers match.

19. The system as in claim 18 wherein the host computer is coupled to an indicator, the indicator adapted to indicate if a mismatch is determined between the portion of the identifiers.

20. A method of processing sheets prior to mailing, the method comprising:

receiving first and second sheets with a receiver, the first sheet originating from a stack of first sheets and the second sheet originating from a stack of second sheets;

reading a first identifier on the first sheet with a first read head;

reading a second identifier on the second sheet with a second read head;

reading a third identifier on the first sheet with a third read head;

reading a fourth identifier on the second sheet with a fourth read head;

comparing the first and second identifiers and the third and fourth identifiers to determine whether a match exists; and signaling an error if the first and second identifiers or the third and fourth identifiers do not match.

21. The method as in claim 20 wherein the first sheet comprises a first customer account statement having the first identifier, and the second sheet comprises a check associated with the first customer account and having the second identifier.

22. The method as in claim 21 further comprising retrieving at least one insert to match with the first customer statement based at least in part on the first identifier.

23. The method as in claim 21 wherein the first sheet further comprises a second customer account statement having the third identifier, and the second sheet further comprises a check associated with the second customer account and having the fourth identifier.

24. The method as in claim 23 further comprising separating the first customer account statement from the second customer account statement.

25. The method as in claim 24 further comprising separating the check associated with the first customer account from the check associated with the second customer account at a same time as separating the first and second customer account statements.

26. The method as in claim 24 further comprising separating a received portion of the first and second sheets from a next portion of the first and second sheets if a match is determined.

* * * * *

UNITED STATES PATENT AND TRADEMARK OFFICE

CERTIFICATE OF CORRECTION

PATENT NO. : 7,284,749 B2
APPLICATION NO. : 10/946910
DATED : October 23, 2007
INVENTOR(S) : Greene, III et al.

It is certified that error appears in the above-identified patent and that said Letters Patent is hereby corrected as shown below:

Claim 26, column 10, line 46, delete "claim 24", and insert --claim 20--.

Signed and Sealed this

Sixth Day of May, 2008

JON W. DUDAS
*Director of the United States Patent and Trademark Office*